US006020818A

United States Patent [19]

Chittenden

[11] Patent Number: 6,020,818

[45] Date of Patent: Feb. 1, 2000

[54] SPORT APPARATUS LOCATOR DEVICE

[76] Inventor: Bruce Chittenden, 7600 NW. 84 Ave., Parkland, Fla. 33067

[21] Appl. No.: 09/030,696

[22] Filed: Feb. 25, 1998

[51] Int. Cl.[7] ..... G08B 21/00

[52] U.S. Cl. ..... 340/568.6; 340/529; 340/539; 340/571

[58] Field of Search ..... 340/571, 568, 340/539, 529, 568.6

[56] References Cited

U.S. PATENT DOCUMENTS

| | | | |
|---|---|---|---|
| 4,279,433 | 7/1981 | Petaja | 340/571 |
| 4,535,322 | 8/1985 | Yeski | 340/571 |
| 4,603,328 | 7/1986 | Larson | 340/666 |
| 4,835,523 | 5/1989 | Pruett | 340/571 |
| 5,000,482 | 3/1991 | Cimino | 280/809 |
| 5,001,461 | 3/1991 | Vroom et al. | 340/571 |
| 5,235,321 | 8/1993 | Rowan et al. | 340/571 |
| 5,260,689 | 11/1993 | Meyers et al. | 340/571 |
| 5,324,063 | 6/1994 | Locantro | 280/637 |

OTHER PUBLICATIONS

5280, "Powder Tips", http://www.5280pub.com/library/0196/powdertips.html (1996).

*Primary Examiner*—Glen Swann
*Attorney, Agent, or Firm*—Testa, Hurwitz & Thibeault LLP

[57] ABSTRACT

A locator device for a sport apparatus and a method for determining the location of a sport apparatus. In one embodiment, the device has a delay timer circuit an activation control in communication with the delay timer circuit, and a detection element also in communication with the delay timer circuit. In another embodiment, the activation control is a pressure switch. In yet another embodiment, the device also has an on-off control in communication with the delay timer circuit.

19 Claims, 3 Drawing Sheets

SPORT APPARATUS LOCATOR DEVICE

FIELD OF THE INVENTION

The present invention relates generally to a device which is used to determine the location of a sport apparatus. More specifically, the invention relates to a locator device positioned on a sport apparatus which enables a user to determine the location of a sport apparatus which has become separated from the user.

BACKGROUND OF THE INVENTION

Many sports are performed on non-solid surfaces, such as snow, water or sand, using sport apparatuses adapted for use on these surfaces. Under certain circumstances, however, a user of such a sport apparatus may lose the sport apparatus under the non-solid surface. For example, a snow ski may be released from a user during a fall and may become lost under powder snow.

One previous device used to locate a lost ski involves a leash which tethers the ski to the user. However, if the user falls, the tethered ski is dragged along with the user, risking injury to the user and damage to the ski.

Another previous device used to locate a lost ski involves a long brightly colored cord attached at one end to the ski with the remaining length packed into a small pouch which is attached to the user's leg. In a fall which separates the ski from the user, the brightly colored cord deploys leaving a trail to the lost ski. However, this device is cumbersome and the cord itself is prone to becoming lost under deep powder snow.

The present invention addresses these problems and sets forth a locator device which allows the user to easily determine the location of a lost sport apparatus without risking injury to the user or damage to the sport apparatus.

BRIEF DESCRIPTIONS OF THE DRAWINGS

This invention is pointed out with particularity in the appended claims. The above and further advantages of this invention may be better understood by referring to the following description taken in conjunction with the accompanying drawings in which:

Figure 4A:
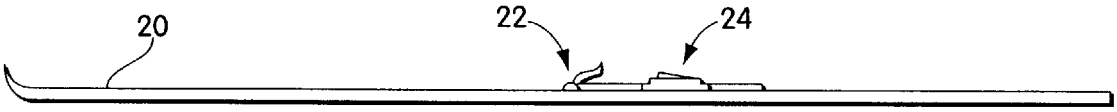
Figure 4B:
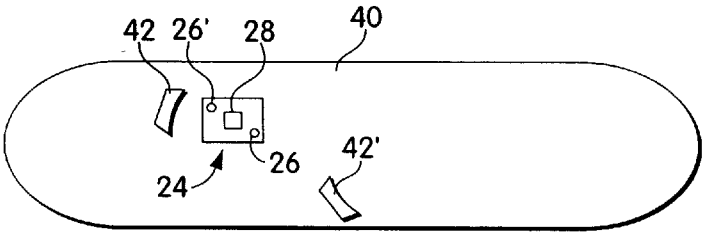
Figure 4C:
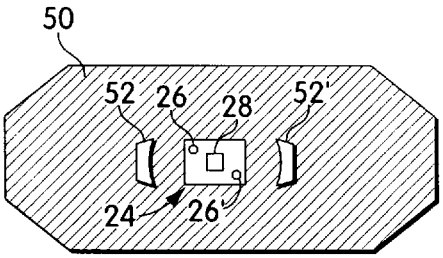

FIG. 4*a* is a side view of an embodiment of a locator device attached to a ski;

FIG. 4*b* is a top view of an embodiment of a locator device attached to a snowboard;

FIG. 4*c* is a top view of an embodiment of a locator device attached to a snow shoe.

Like reference characters in the respective drawn figures indicate corresponding parts.

SUMMARY OF THE INVENTION

The invention relates to a locator device for use with a sport apparatus.

One aspect of the invention provides for an activation control. In one embodiment of the invention, the activation control is mechanical. In another embodiment of the invention, the activation control is electrical. In yet another embodiment of the invention, the activation control is a pressure switch.

One feature of the invention is a detection element. In one embodiment of the invention, the detection element is activated by a pressure switch in response to a change in pressure. In another embodiment of the invention, the detection element is a sound source. In still another embodiment of the invention, the detection element is a light source. In yet another embodiment of the invention, the detection element is a radio frequency source, and the locator device includes a radio frequency receiver.

One aspect of the invention is a delay timer. In one embodiment of the invention, the delay timer is mechanical. In another embodiment of the invention, the delay timer circuit is an electrical circuit. In yet another embodiment of the invention, the delay timer circuit is in communication with a pause selector that allows a user to set the amount of delay time.

In one embodiment of the invention, the locator device has an on-off control. In another embodiment of the invention, the on-off control is in communication with the activation control. In another embodiment of the invention, the on-off control is in communication with the detection element. In yet another embodiment of the invention, the on-off control is in communication with the delay timer circuit. In still another embodiment of the invention, the locator device has an on-off control in communication with a light emitting diode.

One aspect of the invention provides for the attachment of the locator device to a ski. Another aspect of the invention provides for the locator device to be positioned on a binding of a ski. Yet another aspect of the invention provides for the locator device to be positioned adjacent to the binding of a ski.

In one embodiment of the invention, the locator device is attached to a snowboard. In another embodiment of the invention, the locator device is attached to a snow shoe.

In one embodiment of the invention, the method of determining the location of a sport apparatus includes the steps of attaching a locator device to a sport apparatus; triggering an activation control; and activating a detection element. In another embodiment of the invention, the method of determining the location of a sport apparatus includes the steps of attaching a locator device to a sport apparatus; triggering an activation control; activating a delay timer circuit which is in communication with the activation control; and activating a detection element which is in communication with the delay timer circuit.

DETAILED DESCRIPTION OF THE INVENTION

Figure 1:
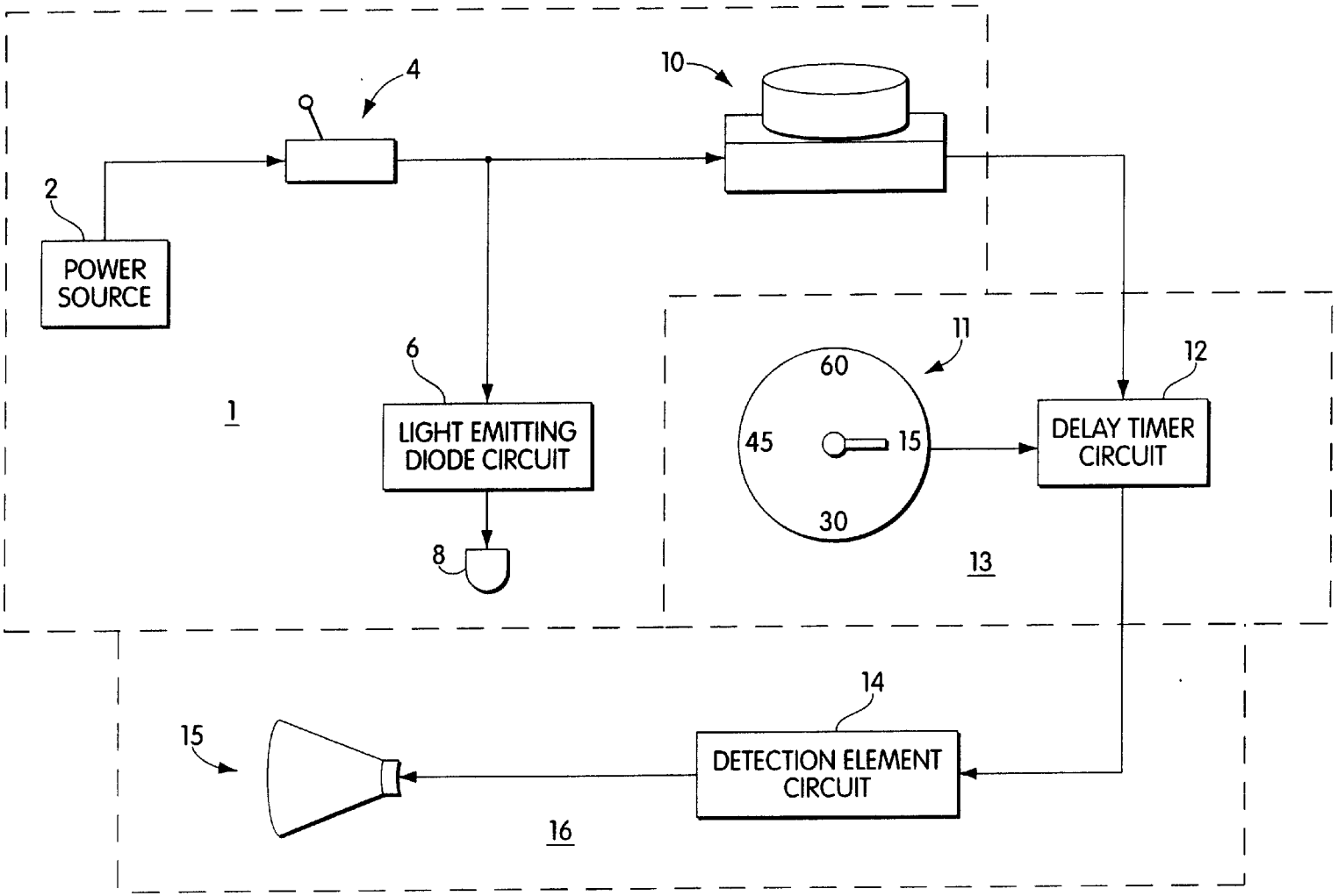
FIG. 1 is a block diagram of an embodiment of a locator device.

In broad overview, and referring to FIG. 1, an embodiment of a locator device of the invention includes an activation module 1, a timer module 13, and a detection module 16. In the embodiment shown, an activation module 1 includes a power source 2 for the locator device, an on-off control 4, a light emitting diode 8 in communication with the on-off control 4 through a light emitting diode circuit 6, and an activation control 10. The timer module 13 includes a delay timer circuit 12 in communication with a pause selector 11. The detection module 16 includes a detection element circuit 14 in communication with a detection element 15, such as an audible sound device.

With more particularity, and as shown in FIG. 1, in one embodiment of the invention, the delay timer circuit 12 is in communication with both the activation control 10 and the detection element circuit 14. The detection element circuit 14 is in communication with the detection element 15.

The activation control 10 is any electrical and/or mechanical system for detecting the separation of a sport apparatus from a user. In a preferred embodiment, the activation control 10 comprises a pressure switch. When the user is engaged with the sport apparatus, the pressure switch is depressed and no signal is transmitted to the delay timer circuit 12. When the sport apparatus comes free from the user, the pressure switch is released actuating the delay timer circuit 12.

In one embodiment, the delay timer circuit 12 is any electrical and/or mechanical system for receiving information from the activation control 10, pausing a predetermined amount of time, and activating the detection element circuit 14. The delay timer circuit 12 allows the user to voluntarily disengage from the sport apparatus without immediately causing the detection element 15 to activate. The delay timer circuit 12 may be preset to pause, for example, 30 seconds between receiving information from the activation control 10 and activating the detection element 15. In the preferred embodiment shown in FIG. 1, the delay timer circuit 12 is in communication with a pause selector 11 which allows the user to select an amount of time for delay. The pause selector 11 may be any electrical and/or mechanical system that allows the user to select an amount of time for delay and that conveys that information to the delay timer circuit 12, such as one or more resistor capacitor (RC) circuits, each with a different time constant. The pause selector 11 may have a continuous selection or may have two or more predetermined amounts of time from which to select, such as 15 seconds, 30 seconds, 45 seconds, and 60 seconds.

The detection element circuit 14 is any electrical and/or mechanical system for receiving information from the delay timer circuit 12 and conveying this information to the detection element 15. The detection element 15 is any electrical and/or mechanical system for receiving a signal from the detection element circuit 14 and performing a function which is either directly or indirectly detectable by a user, such as emitting a sound, a beam of light, or a radio frequency signal. The detection element 15 may include a sound source, such as a speaker or a piezoelectric transducer, or a light source. Alternatively, the detection element 15 may include a radio frequency source. If the detection element 15 includes a radio frequency source, the locator device would also include a radio frequency receiver which remains with the user and which enables the user to detect the transmitted radio frequency signal. In the embodiment shown in FIG. 1, the detection element 15 is a speaker and the detection element circuit 14 is an amplifier. In a preferred embodiment, the detection element 15 emits a sound at a level that is audible under a layer of powder snow. The sound may be periodic or continuous, and the sound may be emitted for a limited duration or indefinitely until the power source 2 for the locator device is exhausted.

In a preferred embodiment of the invention, the locator device includes an on-off control 4. The on-off control 4 is in communication with any one or more of the activation control 10, the detection element 15 and/or, in one embodiment, the delay timer circuit 12. In the embodiment shown in FIG. 1, the on-off control 4 is in communication with a light emitting diode 8 through a light emitting diode circuit 6, and in communication with the activation control 10. When the on-off control 4 is in the 'on' position, the detection element 15 is capable of activation. When the on-off control 5 is in the 'off' position, the detection element 15 is either directly or indirectly incapable of activation. The on-off control 4 allows the user to circumvent activation of the detection element 15 by switching the on-off control 4 to the 'off' position when voluntarily disengaging the sport apparatus. In one embodiment of the invention, the on-off control 4 in communication with a light emitting diode 8 through a light emitting diode circuit 6. The light emitting diode functions to indicate whether the on-off control 4 is in the 'on' or 'off' position. Alternatively, the on-off control may be in communication with any source of detectable output which would allow the user to determine whether the on-off control is in the 'on' or 'off' position, such as an audible sound source or a light source other than a light emitting diode.

To operate a locator device which is positioned on a sport apparatus, a user places the on-off control 4 in the 'on' position and engages the sport apparatus. Then, when the sport apparatus is separated from a user, the activation control 10 is triggered. In the embodiment shown, the activation control 10 actuates the delay timer circuit 12. After pausing a predetermined amount of time, the delay timer circuit 12 activates the detection element 15 through the detection element circuit 14. The detection element circuit 14 then transmits a signal to the detection element 15 which, in response, performs a function which permits the user to determine the location of the sport apparatus.

Although the preferred embodiment of the invention is described herein in terms of electrical components, other embodiments of the invention comprise only mechanical components or various combinations of electrical and mechanical components.

Figure 2:
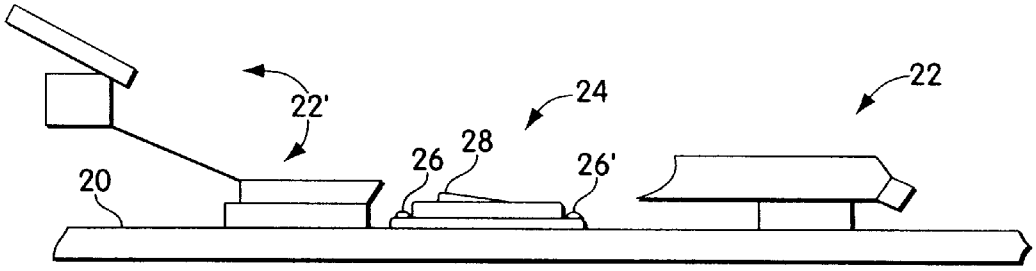
FIG. 2 is a side view of an embodiment of a locator device positioned adjacent to the binding of a ski.
Figure 3:
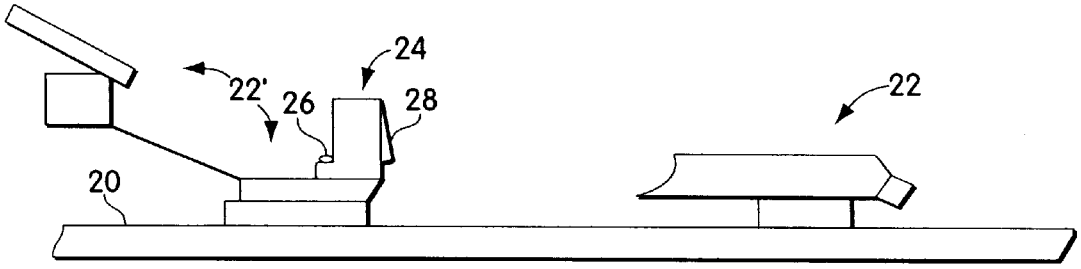
FIG. 3 is a side view of an embodiment of a locator device positioned on the binding of a ski.

FIG. 2 shows an embodiment of a locator device 24 of the invention positioned with an attachment mechanism 26, 26' (generally 26) adjacent to the binding 22, 22' (generally 22) of a ski 20. In this embodiment, the activation control is a pressure switch 28. FIG. 3 shows an embodiment of a locator device 24 of the invention positioned with an attachment mechanism 26, 26' (generally 26) on the binding 22 of a ski 20. In the embodiment shown, the activation control is a pressure switch 28. The attachment mechanism 26 is anything capable of attaching the locator device 24 to the sport apparatus.

FIG. 4*a* shows an embodiment of a locator device 24 of the invention positioned adjacent to a binding 22 on a ski 20. FIG. 4*b* shows an embodiment of a locator device 24 of the invention positioned adjacent to a binding 42, 42' (generally 42) on a snowboard 40, such that the activation control is engaged by the user's foot as it is held in the binding 42. In the embodiment shown in FIG. 4*b*, the activation control is a pressure switch 28, and the locator device 24 is positioned on the snowboard 40 with an attachment mechanism 26. FIG. 4*c* shows an embodiment of a locator device 24 of the invention positioned adjacent to a binding 52, 52' (generally 52) on a snow shoe 50, in which the activation control is a pressure switch 28. The sport apparatus may be any sport apparatus used in conjunction with a non-solid surface, such as snow, sand or water.

Having described preferred embodiments of the invention, it will now become apparent to one of skill in the art that other embodiments incorporating the concepts may be used. Therefore, these embodiments should not be limited to disclosed embodiments but rather should be limited only by the spirit and scope of the following claims.

What is claimed is:

1. A locator device for a sport apparatus comprising:

an activation control;

a detection element in communication with said activation control; and a delay timer circuit in communication with said activation control and said detection element, wherein said delay timer circuit is actuated by a triggering of said activation control, and wherein said detection element provides an indication of the location of the sport apparatus in response to said delay timer circuit.

2. The locator device of claim 1 wherein said activation control is electrical.

3. The locator device of claim 1 wherein said detection element comprises a sound source.

4. The locator device of claim 1 wherein said detection element comprises a light source.

5. The locator device of claim 1 further comprising a radio frequency receiver and wherein said detection element comprises a radio frequency source.

6. The locator device of claim 1 further comprising an on-off control in communication with said activation control.

7. The locator device of claim 1 further comprising an on-off control in communication with said detection element.

8. The locator device of claim 1 further comprising an on-off control and a light emitting diode in communication with said on-off control.

9. The locator device of claim 1 wherein the sport apparatus comprises a ski having a binding and said activation control is located on the binding.

10. The locator device of claim 1 wherein the sport apparatus comprises a ski having a binding and said activation control is located adjacent to the binding.

11. The locator device of claim 1 wherein the sport apparatus comprises a snowboard.

12. The locator device of claim 1 wherein the sport apparatus comprises a snow shoe.

13. The locator device of claim 1 wherein said delay timer circuit is electrical.

14. The locator device of claim 1 further comprising a pause selector in communication with said delay timer circuit.

15. The locator device of claim 1 further comprising an on-off control in communication with said delay timer circuit.

16. A locator device for a sport apparatus comprising:

an activation control;

a detection element in communication with said activation control; and a delay timer circuit in communication with said activation control and said detection element, wherein said detection element provides an indication of the location of the sport apparatus in response to the activation of said activation control and wherein said activation control is a pressure switch.

17. A locator device for a sport apparatus comprising:

an activation control;

a detection element in communication with said activation control; and a delay timer circuit in communication with said activation control and said detection element, wherein said detection element provides an indication of the location of the sport apparatus in response to the activation of said activation control, and wherein said activation control is mechanical.

18. A locator device for a sport apparatus comprising:

an activation control;

a detection element in communication with said activation controls; and a delay timer circuit in communication with said activation control and said detection element, wherein said detection element provides an indication of the location of the sport apparatus in response to the activation of said activation control, and wherein said delay timer circuit is mechanical.

19. A method for determining a location of a sport apparatus comprising the steps of:

(a) attaching to the sport apparatus a locator device comprising:

a delay timer;

an activation control in communication with said delay timer; and a detection element in communication with said delay timer, wherein said delay timer is actuated by a triggering of said activation control, and wherein said detection element provides an indication of the location of the sport apparatus in response to said delay timer;

(b) triggering said activation control;

(c) activating said delay timer; and (d) activating said detection element in response to said delay timer.

* * * * *